US006121867A

United States Patent [19]

Uda et al.

[11] Patent Number: 6,121,867

[45] Date of Patent: Sep. 19, 2000

[54] ELECTRICAL COIL ASSEMBLY HAVING A PLURALITY OF COILS ARRANGED IN PAIRS

[75] Inventors: Yutaka Uda; Toshihide Kikuchi, both of Tokyo, Japan

[73] Assignee: Nikon Corporation, Tokyo, Japan

[21] Appl. No.: 09/418,976

[22] Filed: Oct. 14, 1999

Related U.S. Application Data

[62] Division of application No. 08/891,377, Jul. 11, 1997, Pat. No. 6,002,320.

[30] Foreign Application Priority Data

Jul. 15, 1996 [JP] Japan ..... 8-184723

[51] Int. Cl.[7] ..... H01F 5/00; H01F 27/30

[52] U.S. Cl. ..... 336/208; 336/198; 336/200; 336/192

[58] Field of Search ..... 336/198, 200, 336/192, 208; 29/602.1

[56] References Cited

U.S. PATENT DOCUMENTS 4,635,457 1/1987 Ishii et al. .
5,124,870 6/1992 Toyoda .
5,167,518 12/1992 Deacon .
5,170,302 12/1992 Matsumoto .
5,237,165 8/1993 Tingley, III .
5,412,367 5/1995 Shibui et al. .
5,598,327 1/1997 Somerville et al. .
5,719,547 2/1998 Kaneko et al. .

*Primary Examiner*—Michael L. Gellner
*Assistant Examiner*—Anh Mai

[57] ABSTRACT

An electrical coil assembly and method of manufacturing an electrical coil assembly having at least two interconnected electrical coils forming a coil pair with each coil formed with a multiple winding of wire. The electrical coil assembly preferably has at least one pair of electrical coils with a first coil, a second coil and a third coil aligned in tandem. The first coil is formed from a first wire having an inner end and an outer end with the first wire wound in a clockwise or counterclockwise direction from the inner end to the outer end to form multiple layers of the first wire aligned relative to one another in a single row. The second coil is located between the first coil and the third coil, and is formed from a second wire having an inner end and an outer end with the second wire wound in a direction opposite to the direction of the first wire to form multiple layers of the wire aligned relative to one another in a single row. The third coil is formed from a third wire having an inner end and an outer end with the third wire wound in the same direction of the first wire to form multiple layers of the wire aligned relative to one another in a single row. The inner end of the first coil is connected to the inner end of the second coil and the outer end of the second coil is connected to the outer end of the third coil.

20 Claims, 5 Drawing Sheets

ELECTRICAL COIL ASSEMBLY HAVING A PLURALITY OF COILS ARRANGED IN PAIRS

This application is a divisional of application Ser. No. 08/891,377, filed Jul. 11, 1997, now allowed U.S. Pat. No. 6,002,320.

TECHNICAL FIELD

The present invention relates to an electrical coil assembly and related method of manufacturing an electrical coil assembly having a plurality of coils arranged in pairs in which each coil is wound with a flat wire having a rectangular or square cross section.

BACKGROUND OF THE INVENTION

In general, in linear DC motors such as voice coil motors, Fleming's rule applies, to wit: when a coil moves relative to a permanent magnet a force or thrust will be generated based upon the magnetic flux from the permanent magnet and the electric current flowing through the coil. The magnitude of the thrust is proportional to the magnitude of the magnetic flux and the magnitude of the current flow.

The charge that can flow through a conductive wire moving relative to a magnetic field is limited. To increase current flow, the conductive wire needs to be wound a multiple number of times to form a coil which will permit an induced current of increased magnitude to flow therethrough. The magnitude of a linear DC motor thrust is the sum of thrust vectors generated from each of the conductive wires in the coil.

A conductive cable for a coil of conventional technology uses either a round wire having a circular cross-section or a flat wire preferably of rectangular cross-section.

When using a round wire, as shown in FIG. 8, a round wire 1 is wound to form n rows and m layers, making n×m turns.

On the other hand, when using a flat wire having a flat rectangular cross-section, as shown in FIG. 9, a flat wire 2 is wound to form one row and m layers, making 1×m turns; or as shown in FIG. 10, a flat wire 2 is wound to form n rows and m layers, making n×m turns.

In general, the thrust generated from a coil wound with multiple turns of conductive wire will be equal to the sum of the thrust vectors generated from each of the turns of conductive wire if the magnitude of the magnetic force, the cross-sectional area of the conductive wire, and the number of turns are equal and assuming the vector directions generated in each of the conductive wires are made to be equal. In other words, the thrust for the entire coil can be maximized by aligning each of the conductive wires during winding.

Furthermore, under conditions such that the magnitude of the magnetic force, the cross-sectional area of a conductive wire, and the number of turns are equal, then the higher the proportion of the sum of the cross-section of conductive wires to the cross-section of the coil, the smaller the coil size. In other words, the size of the coil is inversely proportional to the conductive wire packing density for a wire of given size.

When winding a coil using a round wire 1 having a circular cross-section, as shown in FIG. 8, layers of round wire are formed with guiding spaces 3 between the round wires. The spaces 3 between the round wires of the first layer facilitate alignment of the round wire in the second layer.

However, when using a round wire 1 having a circular cross-section, it is difficult to wind the wire into a plurality of turns without causing an overlap from one row to the next after traversing one layer completely, i.e., it is not currently possible to traverse to the next layer without causing some misalignment when overlaying of the wire upon the next layer. The overlap causes a lateral displacement of wire between successive layers. The overlaid sections of wire will deviate from the other sections to limit the packing density of the wire in the coil. In addition, as shown in FIG. 8, the spaces 3 between adjacent round wires 1 also makes it difficult to wind the round wire 1 with high packing density. Moreover, the overlaid sections of wire need to be flattened to prevent the magnitude of the thrust from being affected.

On the other hand, when winding a coil having one row and m layers using a flat wire 2 of rectangular cross-section, as shown in FIG. 9, the space created between adjacent flat wires 2 can be smaller than that created between adjacent round wires 1. Accordingly, this configuration makes it possible to form one row of high density wound coil of flat wire.

Also, in this case, the flat wire 2 does not need to traverse left and right, therefore, the structure makes it possible to vertically align the layers of flat wire 2 in one row between successive turns.

However, when using a flat wire 2 to wind a coil having n rows and m layers, as shown in FIG. 10, it is again difficult to align the flat wire 2 during winding.

In other words, the ratio of the thickness to width of the flat wire 2 is limited and the number of turns the wire can make per row is also limited. To obtain a large thrust, the wire must be turned multiple times, as shown in FIG. 10, requiring multiple traversing of the flat wire 2 both to the left and to the right of each row.

When winding with round wire, the round wire 1 in the bottom layer, limits deviations of the round wire on upper layers in both the right and left directions, that is, the round wire 1 on upper layers can be aligned by aligning the first layer only. However, the use of flat wire 2, does not limit deviations of the flat wire 2 on adjacent layers in the right and left directions. The flat wire 2 should be aligned on all layers.

In general, the flat wire 2 may be made by flattening the round wire 1 into a wire of rectangular cross section. The dimensions of the flat wire 2 in the thickness direction can be relatively uniform, but dimensions in the width direction can hardly be uniform. This can make it difficult to align the flat wire 2 during winding.

In addition, as is the case for the round wire 1, the flat wire 2 must also traverse a layer completely before winding the next layer. If this requires overlaying the flat wire 2 upon making the next layer, a problem develops similar to the problem with round wire in that the overlaid sections cannot be accurately aligned.

The present invention permits winding a coil using a flat wire which can be accurately and readily aligned to form an electrical coil assembly of multiple coils and a multiplicity of turns.

SUMMARY OF THE INVENTION

The electrical coil assembly of the present invention comprises: at least one pair of electrical coils including a first coil and a second coil located contiguous to the first coil;

said first coil being formed from a first wire of flat geometry having an inner end and an outer end with said first wire wound in a clockwise or counterclockwise direction from said inner end to said outer end to form multiple layers of flat wire aligned relative to one another in a single row;

said second coil being formed from a second wire of flat geometry having an inner end and an outer end with said second wire wound in a direction opposite to the direction of said first wire to form multiple layers of flat wire aligned relative to one another in a single row; and wherein the the inner end of said first coil is connected to the inner end of said second coil such that current flowing through said first coil will flow in one direction and then through the second coil in the opposite direction.

The coil of the present invention is preferably composed of a plurality of coil pairs each containing a first coil and a second coil with the outer end of one coil in each coil pair connected to an outer end of a coil in an adjacent coil pair such that current flows serially from one coil pair to another coil pair.

The coil assembly of the present invention is further characterized by the fact that the first and the second coil are made by winding flat wires and that the inner ends and the outer ends of the first and the second coils are located at diagonally opposing corners of each coil. In addition, the inner ends and the outer ends of the first and the second coils form first and second terminals, with the terminals having interconnecting male and female portions.

The coil of the present invention is further characterized by the fact that the first coil and the second coil are made by winding a flat wire around the circumference of a bobbin, and that each bobbin is rectangular and has holes for connection at its corners.

The present invention further comprises a coil assembly of electrical coils with each coil having multiple layers of flat wire arranged in one row made by the process comprising the steps of: laminating a first flat wire around a first coil in a first clockwise or counterclockwise direction to form multiple laminations of flat wire aligned in a single row, alternately laminating a second flat wire around a second coil contiguous to said first coil in a direction opposite to the direction of lamination in said first coil and electrically connecting said first flat wire to said second flat wire such that current flows in alternate directions through each coil in a series circuit relationship.

BRIEF DESCRIPTION OF THE DRAWINGS

The above and other objects, features, and advantages of the present invention will become more apparent from the following detailed description taken with the accompanying drawings, in which.

DETAILED DESCRIPTION OF THE PREFERRED EMBODIMENT OF THE INVENTION

Figure 1:
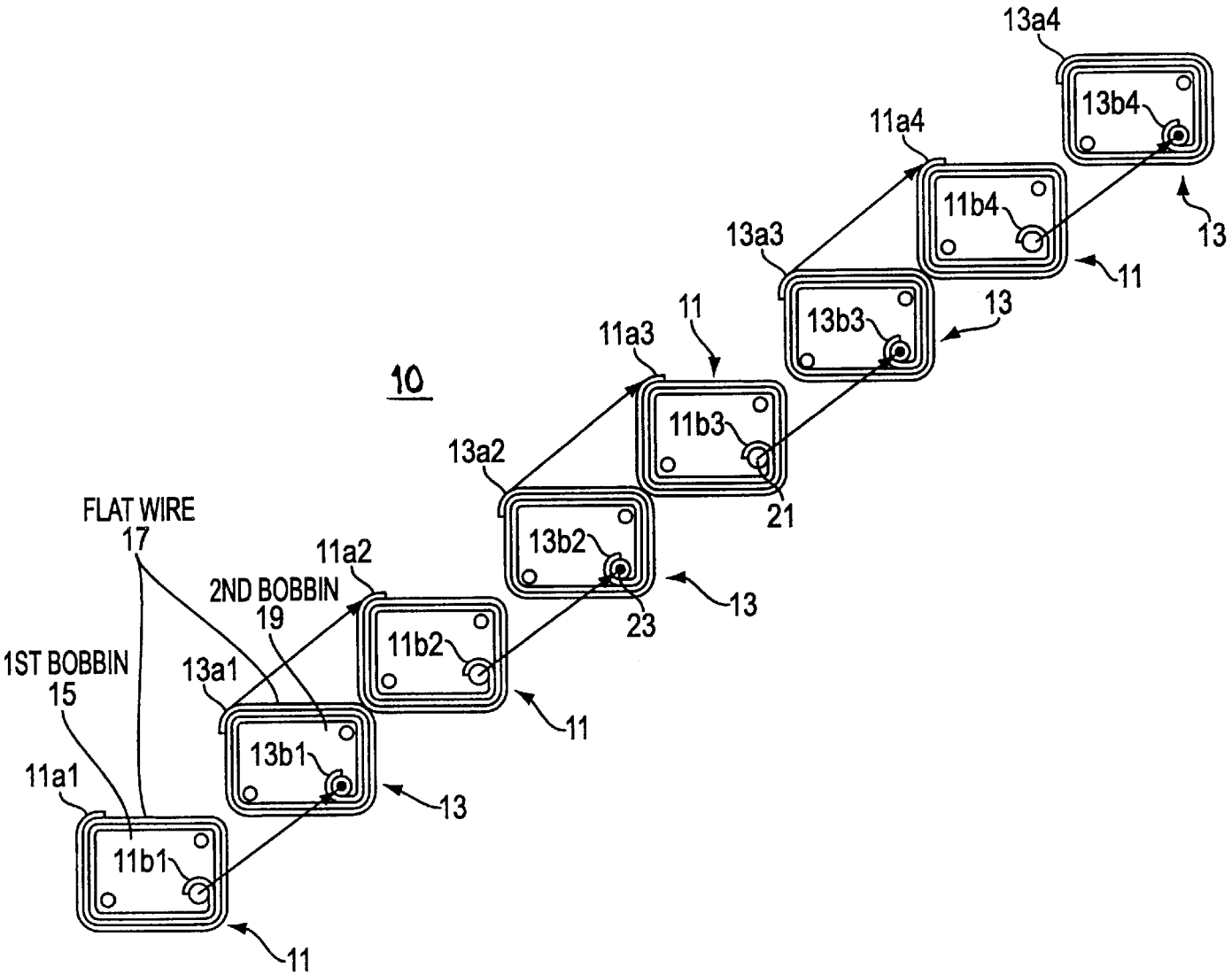
FIG. 1 is a perspective view of one embodiment of the coil assembly of the present invention shown disassembled.
Figure 2:
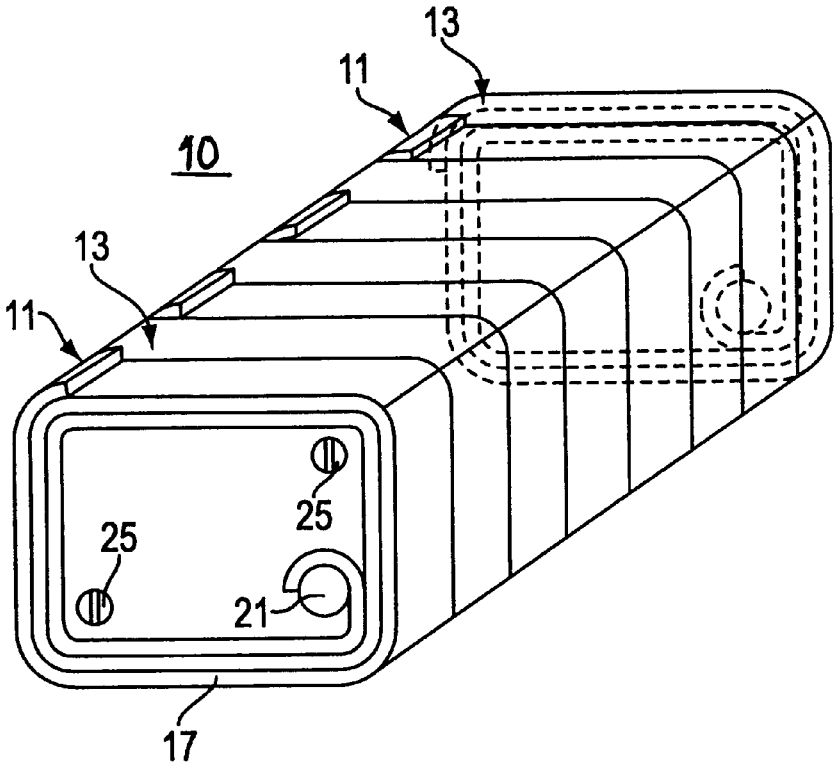
FIG. 2 is a perspective view showing the coil assembly of FIG. 1 fully assembled.

The present invention is described in detail by reference to the drawings in which FIG. 1 and FIG. 2 illustrate a first embodiment of the present invention. The electrical coil assembly 10 of the present invention is formed from a plurality of coils arranged in pairs and in tandem. Each pair of coils includes a coil 11 and an adjacent coil 13. The coil 11 in the first pair of coils has a wound wire conductor with an outer end 11*a*1 and an inner end 11*b*1 whereas the adjacent coil 13 in the first pair of coils has a wound wire conductor with an outer end 13*a*1 and an inner end 13*b*1. The next successive pair of coils 11 and 13 has an outer end 11*a*2 and an inner end 11*b*2 and its adjacent coil 13 has an outer end 13*a*2 and an inner end 13*b*2 and so forth with the letter c,d,e etc. identifying the inner and outer ends of each successive coil 11 and 13 in each coil pair.

Figure 9:
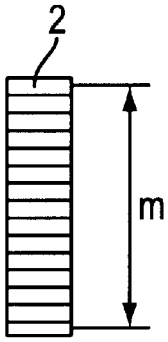
FIG. 9 (PRIOR ART)
FIG. 9 is a descriptive diagram showing a coil of conventional technology wound in one row with a flat wire.
Figure 10:
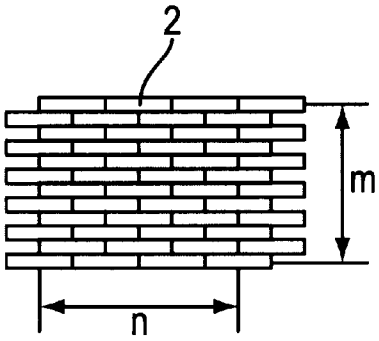
FIG. 10 (PRIOR ART)
FIG. 10 is a descriptive diagram showing a coil of conventional technology wound into a plurality of rows with a flat wire.

In the first pair of coils 11 and 13 the inner end 11*b*1 of coil 11 is connected to the inner end 13*b*1 of coil 13. However the outer end 13*a*1 is connected to the outer end 11*a*2 of the next adjacent pair of coils. A flat wire 17 is laminated around the circumference of each of the coils 11 and 13 to form multiple laminations of flat wire 17 with the windings in each coil forming a single row arrangement of multiple layers or turns as is illustrated in FIG. 9.

The first coil 11 is made by winding a flat wire 17 from inside to outside around the circumference of a rectangular first bobbin 15 such that the flat wire 17 is wound flatly and in a clockwise direction when viewed from the front of the drawing.

The second coil 13 is made by winding the flat wire 17 from inside to outside around the circumference of the rectangular second bobbin 19 such that the flat wire 17 is wound flatly in a counterclockwise direction when viewed from the front of the drawing.

The flat wire 17 is preferably composed of copper with its circumference enamel-coated, whereas the first bobbin 15 and the second bobbin 19 are preferably of a resin or ceramic composition.

As shown in FIG. 1, each pair of coils includes a first coil 11 and a second coil 13 interconnected to each other and to adjacent coil pairs in electrical series with the inner ends in one pair of coils connected together and the outer end of one coil connected to the outer end of an adjacent coil in an adjacent coil pair.

The outer end 11*a*1 of the first coil 11 and the outer end 13*a*1 of the second coil 13 are located at adjacent corners of the bobbin units 15 and 19. Likewise the inner end 11*b*1 of coil 11 and the inner end 13*b*1 of coil 13 are located at adjacent corners of the bobbin units 15 and 19 respectively. The inner end 11*b*1 is located at the diagonally opposite corner from the outer end 11*a*1 of the same bobbin 19. The inner ends of each coil pair are located at diagonally opposite comers from the outer ends of each coil pair respectively.

Figure 3:
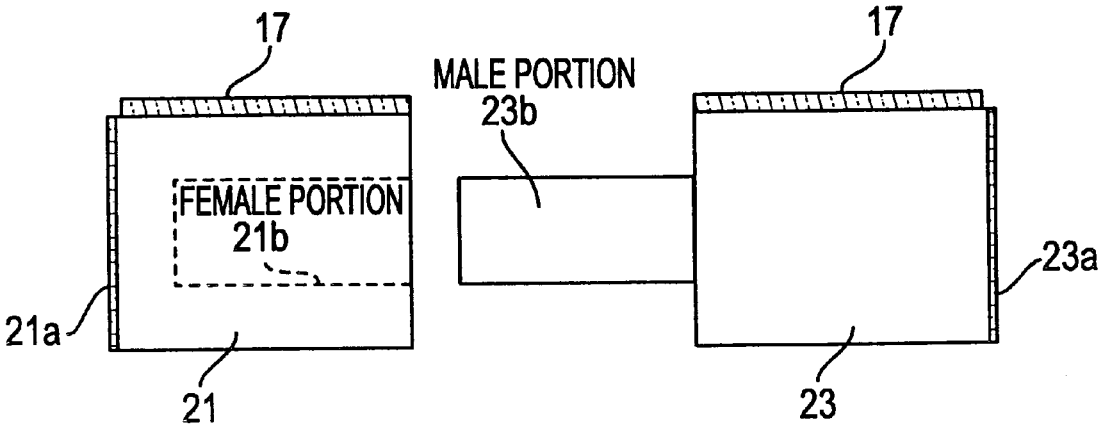
FIG. 3 is a side view of a first terminal and a second terminal of FIG. 1.

The inner end 11*b*1 of the first coil 11 forms a first terminal 21, preferably of copper. The first terminal 21 is insulation-coated with enamel, and so forth, on one side 21*a*, as shown in FIG. 3, and has a female portion 21*b* formed on the other side. The flat wire 17 is fixed onto the circumference of the first terminal 21 by soldering, and so forth.

The inner end 13*b*1 of the second coil 13 forms a second terminal 23 made from a conductive material such as copper, and so forth, and is located adjacent the inner end 11*b*1 of the first coil 11, as shown in FIG. 1.

The second terminal 23 is insulation-coated with enamel 23*a,* and so forth, as also shown in FIG. 3, on one side and has a male portion 23*b* adapted to engage the female portion 21*b* of the first terminal 21. A flat wire 17 is also fixed onto the circumference of the second terminal 23 by soldering, and so forth. The use of terminal connectors 21 and 23, which engage one another, facilitates the coupling of the inner ends 11*b*1 to 13*b*1, as shown in FIG. 1, between the coils 11 and 13, and to facilitate the coupling of the outer ends 13*a*1 and 11*a*2 between adjacent coil pairs.

Figure 4:
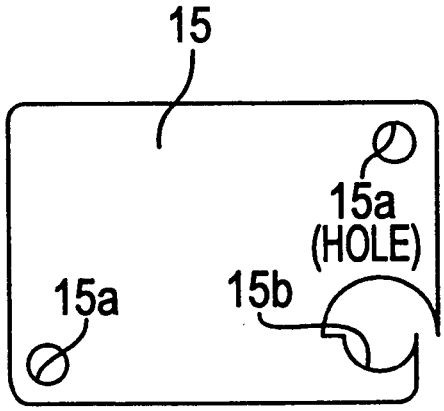
FIG. 4 is a front view of a first bobbin shown in FIG. 1.

FIG. 4 shows details of a first bobbin 15 having holes 15*a* formed at opposed diagonal corners.

An engagement hole 15*b* adapted for engagement of the flat wire 17 to the first terminal 21 is formed at one corner (see FIG. 3) of the first bobbin 15 where the holes 15*a* are not formed.

Figure 5:
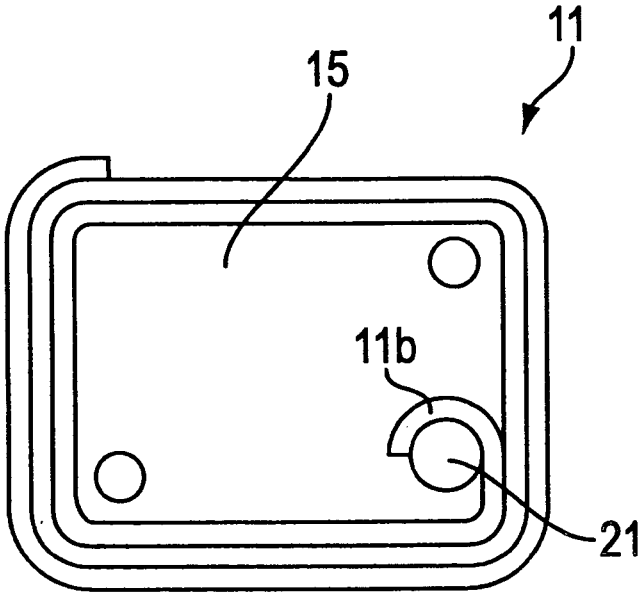
FIG. 5 is a front view of a first coil of FIG. 1.

As shown in FIG. 5, the first terminal 21 is laminated with the flat wire 17 at the engagement hole 15*b* with the flat wire 17 wound along the circumference of the first bobbin 15 to form the first coil 11.

Figure 6:
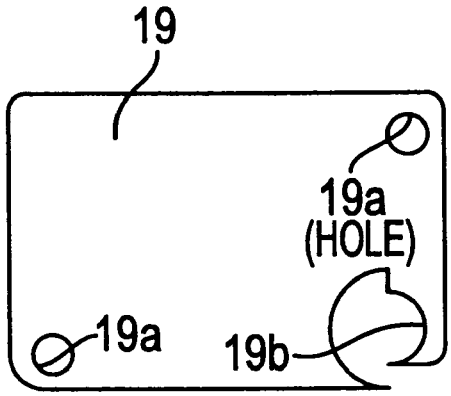
FIG. 6 is a front view of a second bobbin of FIG. 1.

Similarly, FIG. 6 shows the details of the second bobbin 19 having holes 19*a* formed at diagonal corners and an engagement hole 19*b* for engaging the second terminal 23. The engagement hole 19*b* is formed at the corner of the bobbin 19 where the holes 19*a* are not formed.

Figure 7:
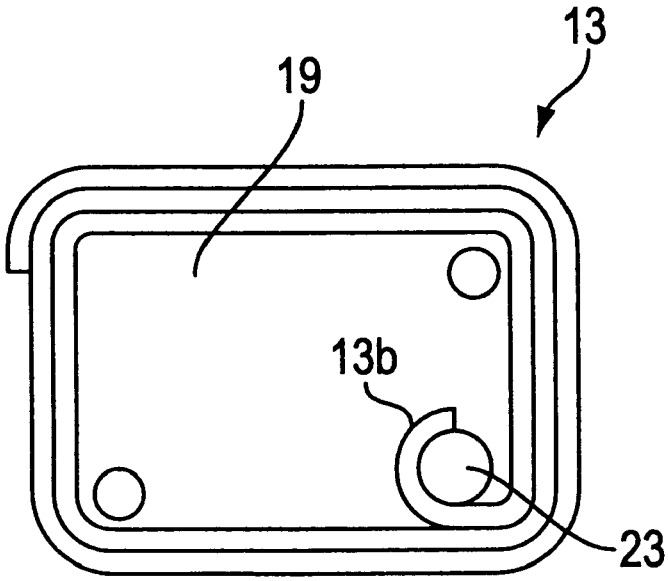
FIG. 7 is a front view of a second coil of FIG. 1.
Figure 8:
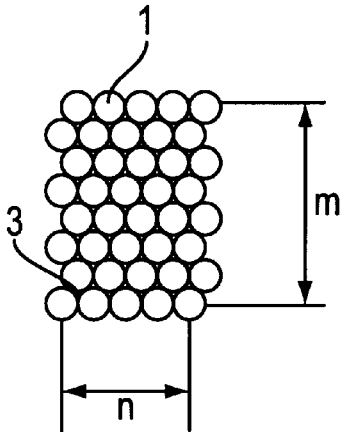
FIG. 8 (PRIOR ART)
FIG. 8 is a descriptive diagram showing a coil of conventional technology wound with a round wire.

The first terminal 23 is also laminated with the flat wire 17 engaged with the engagement hole 19*b*. The flat wire 17 is wound along the circumference of the second bobbin 19 to form the second coil 13, as shown in FIG. 7. In this embodiment, as shown in FIG. 2, a screw 25 is inserted into the holes 15*b* and 19*b* for connecting the first bobbin 15 to the second bobbin 19 with the head of the screw 25 fixed with a nut (not illustrated). The flat wire 17 windings in each coil 11 and 13 are electrically connected one to the other in succession and in a predetermined manner so that each coil 11 and 13 is alternately laminated relative to one another, as shown in FIG. 1.

In the coil arrangement, as shown in FIG. 1, relative to the first coil pair, current flows from the outside of the first coil 11 at the outer end 11*a*1 to its inner end 11*b*1 through the multiple windings of the flat wire 17, and then flows from the inner end 13*b*1 of coil 13 to the outer end 13*a*1 and then through outer end 11*a*2 of the adjacent coil 11 to its inner end 11*b*2 etc. In the second coil 13, the current flows from inside to outside through the flat wire 17, and then flows serially to the next adjacent pair of coils 11 and 13. The flow of current generates a given magnetic field.

A coil assembly having the above configuration can be made by winding the flat wire 17 in each coil 11 and 13 in an alternately laminating arrangement with the winding 17 in each coil wound to form only one row. This makes it easy to align the windings for all of the coils in the coil assembly 10 with high accuracy.

Also, this configuration eliminates the need to overlay the flat wire at the upper layer of one row to the next row, as required in conventional technology. This configuration also makes it possible to align the flat wire 17 with a tighter specification at higher winding density.

In addition, since the aforementioned coil assembly of the present invention is made by winding the flat wire 17 to form multiple turns in single rows, this makes it possible to generate magnetic fields evenly at the rectangular sides of the rectangular coils. Since the bobbins 15 and 19 have a rectangular cross section the coils 11 and 13 will necessarily have a rectangular cross section. Obviously, if the bobbins are of another geometry the coils 11 and 13 will likewise be of such other geometry.

Since the inner ends 11*b*1 and 13*b*1 of one pair of coils 11 and 13 are located at adjacent corners of their respective bobbins 15 and 19 and the outer ends 13*a*1 and 11*a*2 are located at adjacent comers between bobbins 19 and 15 of adjacent coil pairs the capability to form a uniform magnetic field at the sides the coil assembly 10 is made easier.

By winding the flat wire 17 around the circumference of each bobbin 15 and 19, it is easier to electrically connect the coils together and to form a series connection between the coils. The use of holes 15*a* and 19*a* at the corners of the rectangular bobbin units 15 and 19 permit the bobbins to be connected together using, for example, a screw. This facilitates assembling the coil 10, as shown in FIG. 2, without affecting the uniformity of the magnetic field.

The present invention is not limited to the above-described embodiment, in which the same number of coils 11 and 13 are arranged in pairs. For example, one more of either the first or second coil may be attached at the end of the assembly.

Moreover, the present invention is not to be construed as limited to the use of a first coil 11 and a second coil 13 of rectangular geometry. For example, the diagonal two sides may be formed semicircularly to form an oval. Other geometries are also usable in forming the coil assembly 10 in conjunction with the use of a flat wire 17.

In addition, various modifications will become possible for those skilled in the art after receiving the teachings of the present disclosure without departing from the scope thereof.

What is claimed is:

1. An electrical coil assembly comprising:

at least one set of electrical coils including a first coil, a second coil and a third coil aligned in tandem;

said first coil being formed from a first wire having an inner end and an outer end with said first wire wound in a clockwise or counterclockwise direction from said inner end to said outer end to form multiple layers of the first wire aligned relative to one another in a single row;

said second coil located between said first coil and said third coil, and being formed from a second wire having an inner end and an outer end with said second wire wound in a direction opposite to the direction of said first wire to form multiple layers of the second wire aligned relative to one another in a single row; and said third coil being formed from a third wire having an inner end and an outer end with said third wire wound in a same direction of said first wire to form multiple layers of the third wire aligned relative to one another in a single row, wherein the inner end of said first coil is connected to the inner end of said second coil and the outer end of said second coil is connected to the outer end of said third coil, and the first coil is not connected to the third coil directly.

2. An electrical coil assembly as defined in claims 1, wherein current flowing through said first coil will flow in one direction and then through the second coil in the opposite direction of the one direction and then through the third coil in the same direction of the one direction.

3. An electrical coil assembly as defined in claims 1, wherein each coil has a cross-sectional geometry of substantially rectangular configuration forming corners at opposite ends thereof with said inner end and said outer end located at different corners.

4. An electrical coil assembly as defined in claim 3, wherein said inner end and said outer end in each coil are located at diagonally opposite corners from one another.

5. An electrical coil assembly as defined in claim 1, further comprising an electrical terminal connector for said inner end and for said outer end of each coil, respectively.

6. An electrical coil assembly as defined in claim 5, wherein the terminal connector located at said inner end of each coil has a male or female portion and the terminal connector located at the corresponding inner end of the adjacent coil has a corresponding opposite female or male portion such that the terminal connectors may interconnect to electrically connect the wire in one coil to the wire in an adjacent coil at the inner ends, respectively.

7. An electrical coil assembly as defined in claim 5, wherein the terminal connector located at said outer end of each coil has a male or female portion and the terminal connector located at the outer end of the coil in an adjacent pair of coils has a corresponding opposite female or male portion such that the terminal connectors may interconnect to electrically connect the wire in one coil to the wire in an adjacent coil of an adjacent pair of coils at the outer ends, respectively.

8. An electrical coil assembly as defined in claim 5, wherein each coil further comprises a bobbin around which said wire is wound.

9. An electrical coil assembly as defined in claim 8, wherein each bobbin in each coil has a cross-sectional geometry of substantially rectangular configuration.

10. An electrical coil assembly as defined in claim 9, wherein each bobbin includes holes located at each of its corners adapted for connecting each bobbin to one another.

11. A method of manufacturing an electrical coil assembly comprising:

winding a first wire in a clockwise or counterclockwise direction from an inner end to an outer end to form first multiple layers of the first wire aligned relative to one another in a single row;

winding a second wire in a direction opposite to the direction of said first wire to form second multiple layers of the second wire aligned relative to one another in a single row;

winding a third wire in a same direction of said first wire to form third multiple layers of the third wire aligned relative to one another in a single row;

aligning said first, second, and third multiple layers in tandem with said second multiple layers being located between said first and third multiple layers;

connecting said inner end of said first multiple layers and said inner end of said second multiple layers;

connecting said outer end of said second multiple layers to said outer end of said third multiple layers; and isolating said first multiple layers from said third multiple layers by not connecting said first multiple layers with said third multiple layers directly.

12. A method according to claim 11, wherein each of said multiple layers has a cross-sectional geometry of substantially rectangular configuration forming corners at opposite ends thereof with said inner end and said outer end located at different corners.

13. A method according to claim 12, wherein said inner end and said outer end in each of said multiple layers are located at diagonally opposite corners from one another.

14. A method according to claim 11, further comprising:

providing an electrical terminal connector for said inner end and for said outer end of each of said multiple layers.

15. A method according to claim 14, further comprising:

providing a male or female portion at said inner end of each of said multiple layers with said terminal connector at the corresponding inner end of the adjacent multiple layers having a corresponding opposite female or male portion; and interconnecting said male portion to said female portion corresponding to said male portion to electrically connect the wire in one of said multiple layers to the wire in an adjacent one of said multiple layers at the inner ends, respectively.

16. A method according to claim 14, further comprising:

providing a male or female portion at said outer end of each of said multiple layers with said terminal connector at the corresponding outer end of the adjacent multiple layers having a corresponding opposite female or male portion; and interconnecting said male portion to said female portion corresponding to said male portion to electrically connect the wire in one of said multiple layers to the wire in an adjacent one of said multiple layers at the outer ends, respectively.

17. A method according to claim 14, wherein each of said multiple layers comprises a bobbin around which said wire is wound.

18. A method according to claim 17, wherein each bobbin in each of said multiple layers has a cross-sectional geometry of substantially rectangular configuration.

19. A method according to claim 18, wherein each bobbin includes holes located at each of its corners adapted for connecting each bobbin to one another.

20. An electrical coil assembly comprising:

at least one set of electrical coils including a first coil, a second coil and a third coil aligned in tandem;

said first coil being formed from a first wire having an inner end and an outer end with said first wire wound in a clockwise or counterclockwise diction from said inner end to said outer end to form multiple layers of the first wire aligned relative to one another in a single row;

said second coil located between said first coil and said third coil, and being formed from a second wire having an inner end and an outer end with said second wire wound in a direction opposite to the direction of said first wire to form multiple layers of the second wire aligned relative to one another in a single row;

said third coil being formed from a third wire having an inner end and an outer end with said third wire wound in a same direction of said first wire to form multiple layers of the third wire aligned relative to one another in a single row; and an electrical terminal connector for said inner end and for said outer end of each coil, respectively, wherein each coil further comprises a bobbin around which said wire is wound, with each bobbin in each coil having a cross-sectional geometry of substantially rectangular configuration, and with each bobbin including holes located at each of its corners adapted for connecting each bobbin to one another, and wherein the inner end of said first coil is connected to the inner end of said second coil and the outer end of said second coil is connected to the outer end of said third coil.

* * * * *

UNITED STATES PATENT AND TRADEMARK OFFICE

CERTIFICATE OF CORRECTION

PATENT NO.: 6,121,867
DATED : September 19, 2000
INVENTOR(S): Yutaka UDA, et al.

It is certified that error appears in the above-identified patent and that said Letters Patent is hereby corrected as shown below:

Column 6, line 60 (claim 2), change "claims" to --claim--;
line 65 (claim 3), change "claims" to --claim--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*